US007757619B2

(12) United States Patent
Youngblood et al.

(10) Patent No.: US 7,757,619 B2
(45) Date of Patent: Jul. 20, 2010

(54) FUEL-BURNING FURNACE WITH A CHUTE THAT EJECTS MATERIAL FROM THE COMBUSTION CHAMBER BY FORCE OF THE LOADING OF FUEL

(75) Inventors: Douglas Brian Youngblood, Diamond, MO (US); Bruce Martin Youngblood, Diamond, MO (US)

(73) Assignee: Youngblood Holdings, LLC, Diamond, MO (US)

( * ) Notice: Subject to any disclaimer, the term of this patent is extended or adjusted under 35 U.S.C. 154(b) by 457 days.

(21) Appl. No.: 11/764,835

(22) Filed: Jun. 19, 2007

(65) Prior Publication Data

US 2008/0314299 A1 Dec. 25, 2008

(51) Int. Cl.
*F23K 3/00* (2006.01)
*F23G 5/00* (2006.01)
*F23M 7/00* (2006.01)

(52) U.S. Cl. ..... 110/327; 110/116; 110/173 R; 110/346

(58) Field of Classification Search ..... 110/196, 110/235, 242, 255, 259, 289, 290, 346, 349, 110/165 R, 166, 170, 173; 198/468.11
See application file for complete search history.

(56) References Cited

U.S. PATENT DOCUMENTS 2,953,108 A * 9/1960 Kelsen ..... 110/173 R
3,031,981 A 5/1962 Smauder
3,841,242 A 10/1974 Sigg
3,855,950 A * 12/1974 Hughes et al. ..... 110/212
4,029,026 A 6/1977 Normantas
4,172,425 A 10/1979 Sheridan
4,177,723 A 12/1979 Buchele et al.
4,217,878 A 8/1980 Wieweck
4,218,980 A 8/1980 Probsteder
4,449,510 A 5/1984 Sukup
4,534,301 A 8/1985 Sakash et al.
4,534,302 A 8/1985 Pazar
4,650,546 A * 3/1987 Le Jeune ..... 110/230
4,884,515 A 12/1989 Falconnet
5,086,714 A 2/1992 Hladun
5,279,234 A * 1/1994 Bender et al. ..... 110/214
5,315,937 A 5/1994 Williams
5,678,494 A 10/1997 Ulrich
5,743,196 A * 4/1998 Beryozkin et al. ..... 110/222
6,067,915 A * 5/2000 Sharpe ..... 110/234

FOREIGN PATENT DOCUMENTS

DE 3612059 A1 * 10/1987

* cited by examiner

*Primary Examiner*—Kenneth B Rinehart
*Assistant Examiner*—David J Laux
(74) *Attorney, Agent, or Firm*—Martin & Associates, LLC; Derek P. Martin

(57) ABSTRACT

A furnace includes a chute extending from the back of a combustion chamber to allow for the material in the combustion chamber to be pushed into the chute and ejected from the chute by the force of new fuel being pushed into the furnace. No time is lost in cleaning out the furnace as the cleaning of the furnace happens as a byproduct of fuel being loaded into the furnace. The ease and efficiency of operation, in that the cleaning happens by performing the necessary task of loading the furnace with fuel, will allow furnace operation in a more simple, convenient, and safe manner without requiring the furnace to be shut down.

18 Claims, 4 Drawing Sheets

FUEL-BURNING FURNACE WITH A CHUTE THAT EJECTS MATERIAL FROM THE COMBUSTION CHAMBER BY FORCE OF THE LOADING OF FUEL

BACKGROUND

1. Technical Field

This disclosure generally relates to furnaces, and more specifically relates to combustion furnaces that burn fuel in a combustion chamber.

2. Background Art

Furnaces of various different sizes and configurations have been developed for the burning of fuel, such as large bales of hay. These furnaces typically have one door, or set of doors that cover an opening to the inside of the furnace. Fuel is loaded through this opening. These furnaces can consume large amounts of hay which results in large amounts of ash. Some quantity of ash can stay in the furnace without affecting the operation of the furnace, but after a period of time there is so much ash that the ash needs to be removed from the furnace. With only one access point in the furnace, the ash has to go out of the same door where the fuel comes in. This means a person has to get into the furnace and manually shovel out the ashes through the door, or use a piece of machinery to remove the ashes. Regardless of whether ash removal is done manually or by machine, the furnace must generally be allowed to cool to allow a person or machine to enter the furnace without risk of injury to a person or damage to a machine. It takes a long time after the fire in the combustion chamber is no longer burning for a large furnace to cool. This means the need to clean out ash from the furnace may result in the furnace being out of commission for a significant period of time each time it needs to be cleaned.

Whenever the furnace is out of commission, a more expensive heating system must be used in its place costing extra money. It would be very advantageous to have a way to clean out the ashes from the furnace without having to wait for the furnace to cool.

In addition, removing ashes from the same door where fuel is added creates a large pile of ashes that must be removed before new fuel is added to the furnace. If the ashes are not completely removed, the fuel being added may ignite from the hot ashes before the fuel is loaded into the stove.

One possible solution would be to put doors on both sides of the furnace so that you could load fuel from one side and remove ash from the other. However, from a practical standpoint, this creates a dangerous situation. If the furnace were not allowed to cool, when both doors were opened a wind tunnel would be created across the hot fuel and ash, providing a high supply of oxygen to the fuel and ash, and would literally result in a fire tunnel that would be a danger to people or property in the vicinity of the furnace.

Without a way to clean out a large furnace that burns fuel such as large bales of hay in a more simple, convenient and safe manner, the use of such furnaces will continue to be subject to the disadvantages discussed above.

BRIEF SUMMARY

A furnace includes a chute extending from the back of a combustion chamber to allow for the material in the combustion chamber to be pushed into the chute and ejected from the chute by the force of new fuel being pushed into the furnace. No time is lost in cleaning out the furnace as the cleaning of the furnace happens as a byproduct of fuel being loaded into the furnace. The ease and efficiency of operation, in that the cleaning happens by performing the necessary task of loading the furnace with fuel, will allow furnace operation in a more simple, convenient, and safe manner without requiring the furnace to be shut down.

The foregoing and other features and advantages will be apparent from the following more particular description, as illustrated in the accompanying drawings.

BRIEF DESCRIPTION OF THE SEVERAL VIEWS OF THE DRAWING(S)

The disclosure will be described in conjunction with the appended drawings, where like designations denote like elements, and;

DETAILED DESCRIPTION

Figure 1:
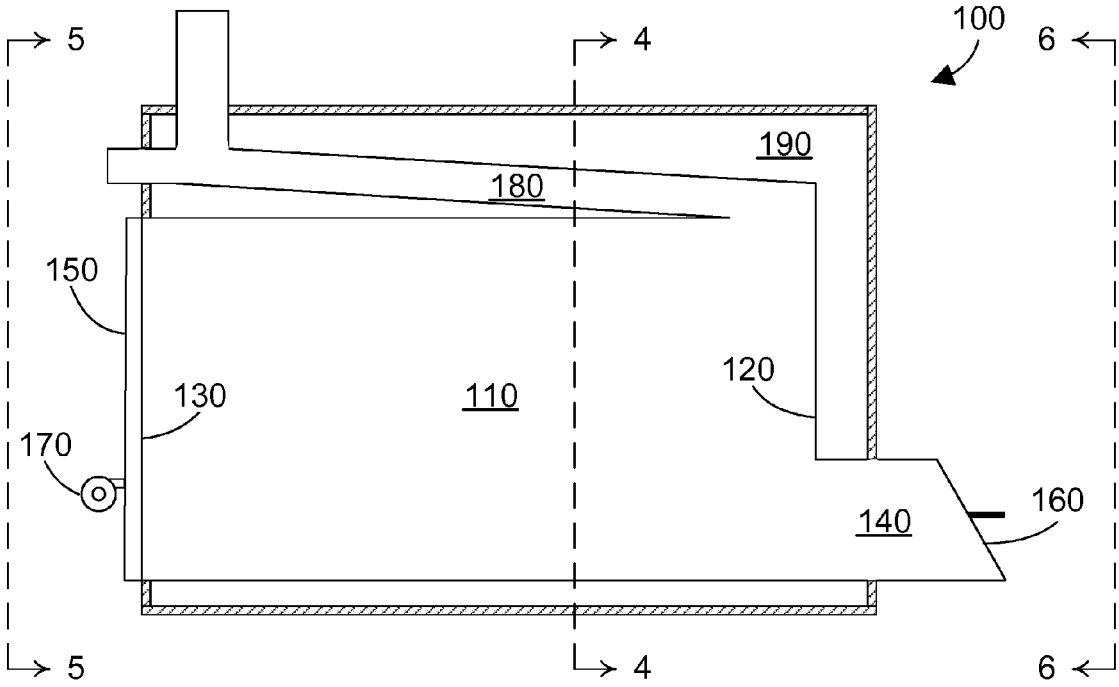
FIG. 1 is a side cross-sectional view of a furnace when the furnace is empty.

A fuel-burning furnace 100 is shown in various views in the figures. The fuel-burning furnace 100 includes a combustion chamber 110 with a front 130 and a back 120, one or more doors 150, a chute 140 with a chute door 160, a blower 170, an exhaust system 180, and a water chamber 190. The bottom portion of combustion chamber 110 is preferably in the shape of a transverse substantially semi-cylindrical surface, thereby providing a curved bottom surface that approximately matches the curvature of a large round bale of hay. The combustion chamber 110 may include one or more heat exchangers preferably near the top of the combustion chamber to increase the surface area for heat transfer, thereby enhancing the transfer of heat from the combustion chamber. Doors 150 are opened to gain access to the combustion chamber 110, such as for loading fuel and for servicing the inside of the combustion chamber 110. The chute 140 has a receiving end coupled to the lower portion of the back of the combustion chamber 120 and a discharge end opposite the receiving end. The chute door 160 is attached to the top of the discharge end of the chute 140 by a hinging mechanism that includes, but is not limited to, hinges, and is normally biased in a closed position by the force of gravity when the combustion chamber 110 is empty.

Doors 150 provide an opening to the combustion chamber 110. Doors 150 may include one or more blowers 170 that provide air flow into the combustion chamber to aid in combustion. Blowers 170 are preferably fixed in location, but could include an oscillating portion that distributes air flow to different parts of the combustion chamber. In the alternative, the blowers 170 could be fixed while motorized louvers in the combustion chamber distribute air flow from the blowers to different parts of the combustion chamber. Exhaust system 180 provides a path for smoke to exit the combustion chamber 110. Water chamber 190 preferably surrounds the combustion chamber 110 to provide an efficient transfer of heat from the combustion chamber 110 to water within the water chamber 190. FIG. 1 shows the fuel-burning furnace 100 when it is empty.

Figure 2:
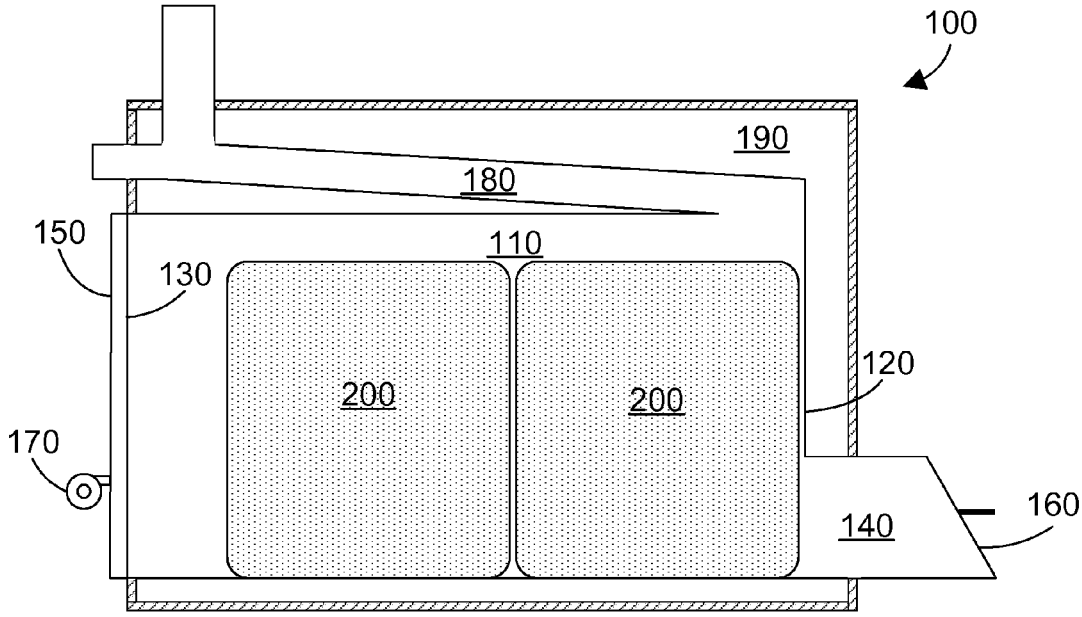
FIG. 2 is a side cross-sectional view of the furnace when the furnace is loaded with fuel.

FIG. 2 shows the fuel-burning furnace 100 in FIG. 1 after it is loaded with fuel 200. The fuel 200 shown in FIG. 2 is large round bales of hay. Fuel may include any combustible material that is capable of pushing material 300 in the combustion chamber as the fuel 200 is loaded into the combustion chamber. Suitable examples of fuel include but are not limited to hay, straw, cornstalks, wood, coal, paper bales, cardboard, etc. Any fuel in any suitable configuration may be used if pushing the fuel into the combustion chamber 110 results in pushing material 300 into chute 140. For example, coal could be placed in burlap sacks, and the sacks of coal could then be loaded into the combustion chamber 110 in a way that pushes material 300 into chute 140. In the alternative, any form of biomass could be compressed into any suitable shape to provide fuel that is solid enough to push against material 300 as the fuel is pushed into the combustion chamber 110. Material 300 includes but is not limited to ash, burning fuel, rocks, and dirt.

Figure 3:
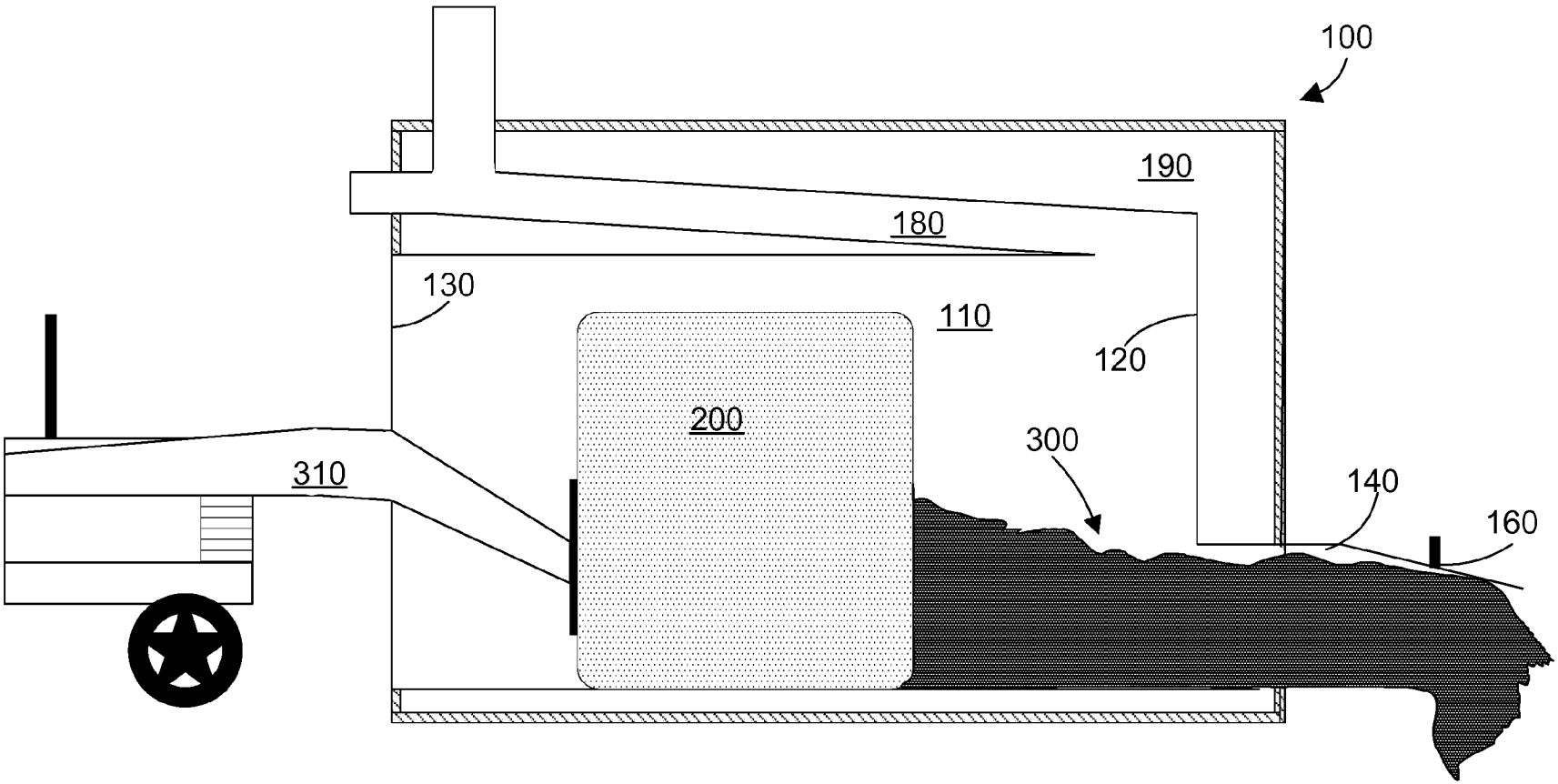
FIG. 3 is a side cross-sectional view of fuel being loaded into the furnace pushing material into a chute.

FIG. 3 shows the fuel-burning furnace 100 and a front-end portion of a tractor 310 loading new fuel 200 into the combustion chamber 110. The new fuel 200 pushes against material 300 and pushes material 300 into the chute 140. The material 300 in chute 140 presses against the chute door 160, pushing chute door 160 open and discharging a portion of material 300 through the discharge end of chute 140. In the most preferred operation of a furnace that burns large, round bales of hay, the hay is placed partially within the combustion chamber, then is lowered to contact the bottom of the combustion chamber so the act of pushing the bale into the combustion chamber effectively sweeps the material from the bottom of the combustion chamber and pushes the material 300 into chute 140.

Figure 6:
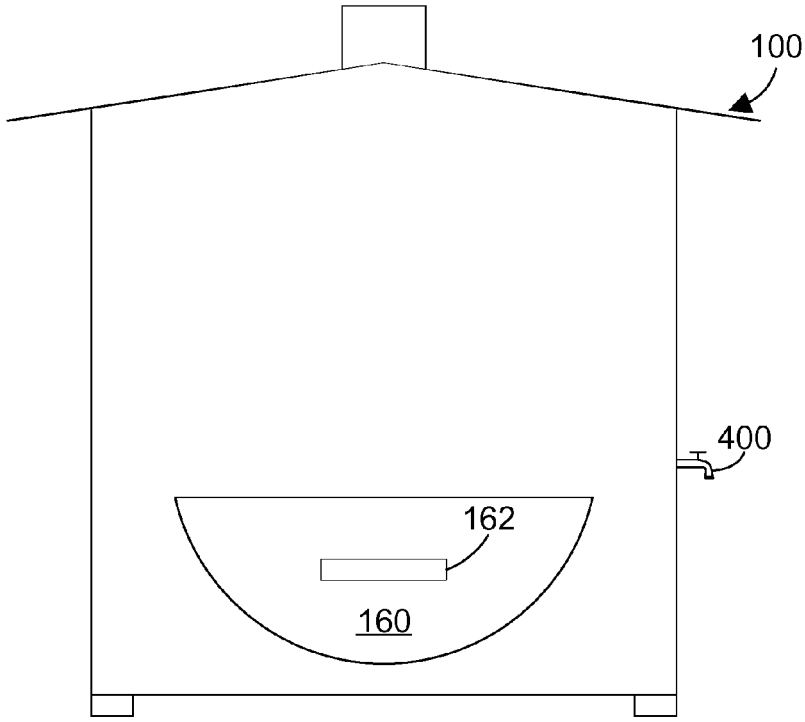
FIG. 6 is a view of the rear of the furnace in FIG. 1 taken along the line 6-6.

The chute 140 can be shaped to the shape of the type of fuel that is being used. For example, the bottom of chute 140 may have a curved shape that would be ideal for large round bales of hay. This curved shape is shown in FIG. 6 in the outside rear view of the fuel-burning furnace 100. In another example, large rectangular bales of hay, straw, paper, or cardboard could be used as fuel. In this case, the bottom of chute 140 could be flat and could extend the width of the combustion chamber. The disclosure and claims herein expressly extend to any suitable size and shape for chute 140. In the most preferred implementation, the bottom of chute 140 is a continuation of the bottom of the combustion chamber 110.

Figure 7:
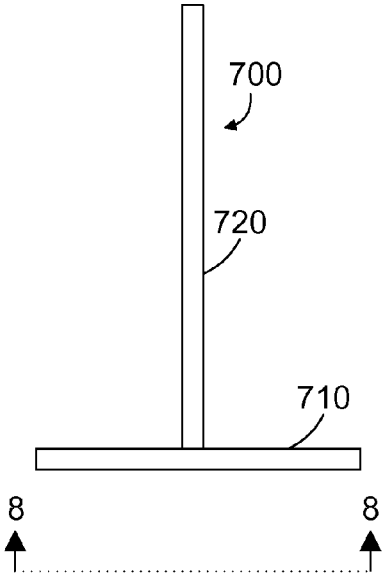
FIG. 7 is a top view of a pushing tool.
Figure 8:
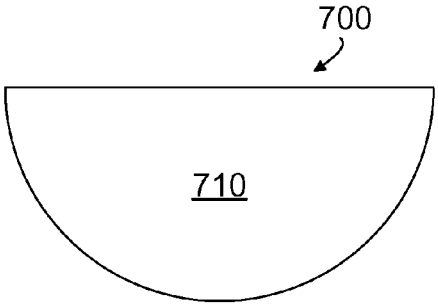
FIG. 8 is a front view of the pushing tool in FIG. 7 taken along the line 8-8.

A fuel-burning furnace is not normally used year round and often goes idle during the summer months. During these idle times it is often good to do a thorough cleaning of the fuel-burning furnace so that it is cleaned out before the furnace is used continuously again. A pushing tool 700 is shown in FIGS. 7-8 that conforms to the shape of the bottom of the combustion chamber. For the preferred implementation for burning round bales of hay, the chute 140 has a curved bottom that extends the curved bottom of the combustion chamber 110. As a result, the pushing tool 700 has a head 710 that has a curved surface that matches the curvature of the bottom of the combustion chamber 110. The pushing tool 700 includes an elongated portion 720 that may be attached to a suitable piece of equipment, such as a front-end loader on a tractor or a forklift. The pushing tool 700 may be used to push material 300 into the chute 140, or may be used to pull material 300 out of the combustion chamber 110. Note also the pushing tool 700 could be used to push material 300 into the chute 140 when the furnace is still hot. The pushing tool 700 can thus provide an extension to a tractor that allows the tractor to push the material 300 into the chute 140 without the tractor tires entering the combustion chamber 110, thereby allowing the pushing tool 700 to clean out a combustion chamber even when the furnace is hot.

Figure 9:
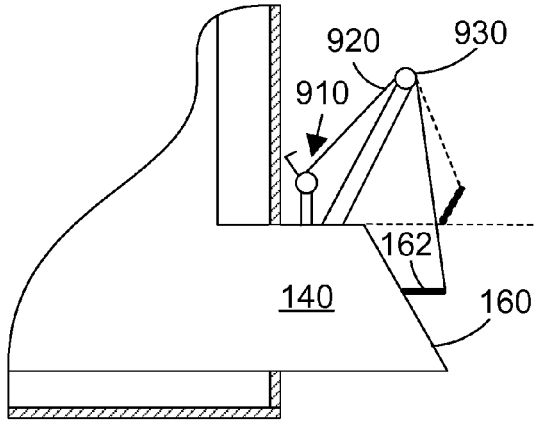
FIG. 9 is a side view of a hand crank used to open chute door 160.

To prevent chute door 160 from getting stuck on material 300 after fuel 200 is loaded in combustion chamber 110, a hand crank 910 can be used to open chute door 160, as shown in FIG. 9. The hand crank 910 is coupled to a cable 920 that follows a pulley 930 and is connected to handle 162 on chute door 160. By cranking (i.e., turning) the hand crank 920, the chute door 160 may be raised (opened) and lowered (closed). After the chute door 160 is opened using hand crank 910, as shown in phantom in FIG. 9, new fuel 200 can be inserted into the combustion chamber, discharging material 300 as shown in FIG. 3. After the new fuel is inserted into the combustion chamber, any material that would block the chute door 160 from closing is removed using a suitable hand tool such as a hoe or shovel before lowering the chute door 160 with hand crank 910.

Chute door 160 is merely one possibility for the material 300 to leave the chute 140. Any arrangement of mechanisms or openings at the discharge end of the chute, that allow the material to be discharged as new fuel is being loaded into the combustion chamber, is within the scope of the disclosure and claims herein. Examples of possible arrangements include, but are not limited to a chute door, a grate on the bottom of chute 140, and a simple opening on the bottom of chute 140 or at the end of chute 140. However, the chute door is the preferred implementation because closing the chute door cuts off outside air from reaching the combustion chamber 110 via chute 140.

The fuel-burning furnace 100 eliminates the problem of needing to wait for the furnace to cool before removing the material, such as ash, from the combustion chamber. The fuel-burning furnace 100 can be loaded with fuel 200 as shown in FIG. 2, and the fuel can begin burning. The fuel-burning furnace does not need to be shut down for cleaning and the fire does not need to go out before new fuel is added. When the fuel level gets low, doors 150 are opened and new fuel 200 is pushed into the combustion chamber 110, as shown in FIG. 3. This new fuel pushes the material 300 in the combustion chamber 110 into the chute 140. Depending on the amount of material 300 in the combustion chamber 110 and the chute 140, none or some of the material in the chute 140 may be discharged at the discharge end of the chute 140 (e.g., through the chute door 160). The new fuel 200 that is pushed into the combustion chamber 110 catches fire so that this cycle can continue without shutting down the furnace to clean out the combustion chamber 110.

Because material 300 being pushed into chute 140 may cause material 300 to exit the discharge end of the chute 140, there needs to be a safe place for the material 300 to go when exiting the discharge end of the chute 140. In one suitable implementation, a concrete pit is provided below the discharge end of the chute 140. Because concrete is non-flammable, the hot material 300 may fall from the chute 140 into the concrete pit to cool. The pit may include a ramp that provides a tractor with a front-end loader access to clean out the pit when the pit becomes full of ash. In addition, the pit may be water-tight so a pool of water is present in the pit when material is ejected from the chute, causing the hot material to fall in the water and be instantly cooled. The presence of water in the pit will also minimize the dust generated when material is ejected from the chute. A pit that holds water preferably includes a way to drain the water, such as a piece of sheet metal similar to known irrigation gates that may be removed to allow the water to drain from the pit.

Figure 4:
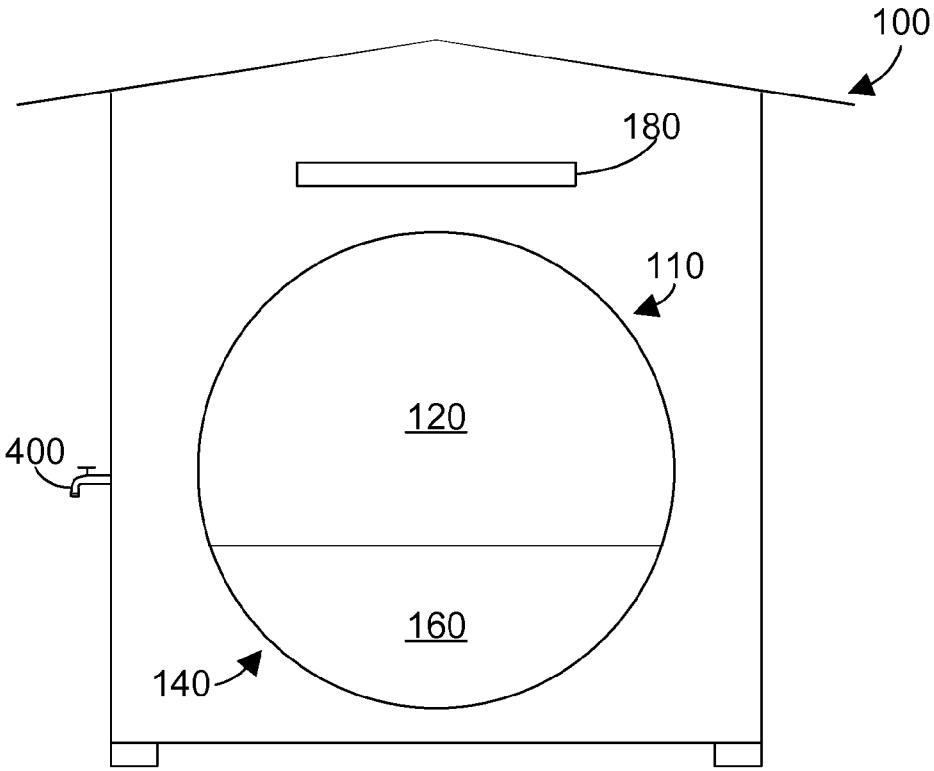
FIG. 4 is a front cross-sectional view of the furnace in FIG. 1 taken along the line 4-4.
Figure 5:
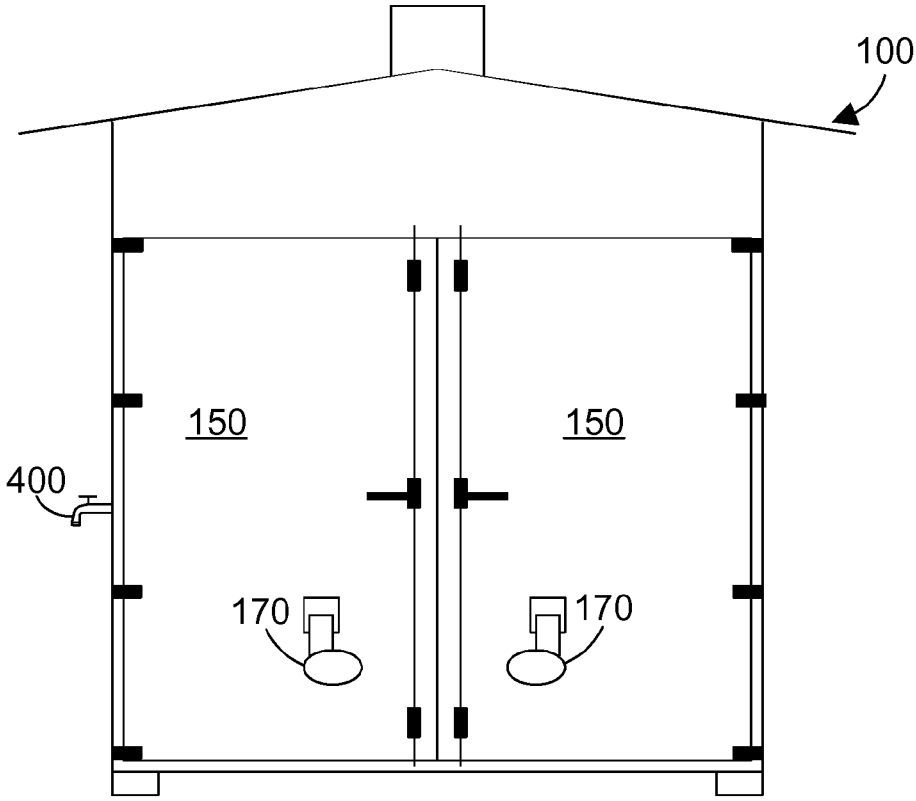
FIG. 5 is a front view of the furnace in FIG. 1 taken along the line 5-5.

Since the fuel-burning furnace 100 is loaded with new fuel while the fire in the combustion chamber is still burning, it is possible that some of the material pushed out of the chute could still be on fire, or may catch fire once exposed to the ambient air outside the furnace. For this reason, a male hose fitting 400 is attached to the water chamber 190 as shown in FIGS. 4-6. This allows a hose such as a standard garden hose to be attached to the male hose fitting 400 to have a source of water readily available to extinguish burning material that exits the chute 140.

FIG. 5 shows the front view of fuel-burning furnace 100. The doors 150 are preferably equipped with one or more blowers 170. The blowers 170 are preferably mounted to the doors to regulate the temperature of fuel-burning furnace 100. The temperature of the furnace may be kept relatively constant by varying the amount of air delivered by blowers 170 to the combustion chamber 110. For example, if the furnace is up to its desired temperature, less air needs to be provided to the fuel, so the blowers are shut off, appearing as if there were no openings in the doors, thereby decreasing the rate of combustion in the combustion chamber. Conversely, if the furnace is not up to its desired temperature, the blowers can be turned on to force air across the fuel causing it to burn more rapidly to increase the rate of combustion in the combustion chamber. In addition, one or more dampers may close when the furnace is up to its desired temperature and the blowers stop blowing, allowing only a minimum of air to keep the fire burning.

Practical experience has shown that many fuels such as hay provide such a hot fire that normal metal doors risk warping under the stress of the extreme heat in the combustion chamber. As a result, the doors 150 preferably include a water jacket that helps to keep the doors at a temperature that keeps the metal on the doors from warping. The water jackets on the doors may communicate with the water chamber 190, thereby allowing the heat at the doors to be transferred to water in the water chamber 190.

While the furnace 100 disclosed herein includes a water chamber 190, the disclosure and claims herein extend to any suitable configuration for transferring heat from the combustion chamber 110 to an area to be heated, such as a farm building.

One suitable use for the fuel-burning furnace 100 would be to heat water in water chamber 190, which can then be used in connection with heat exchangers and blowers to heat a home, chicken house, barn, etc. In the configuration shown in the figures for a furnace that holds two large round bales of hay, the capacity of water chamber 190 is approximately 4,000 gallons, providing a great deal of heating capacity. Depending on the size and configuration of buildings to be heated, if the quantity of water in the water chamber 190 is insufficient to provide the desired heating, a large insulated water reservoir could be coupled to the water chamber 190 to hold water heated by the furnace 100 until it is needed.

An additional benefit to fuel-burning furnace 100 is its size. Fuel-burning furnace 100 is large enough to be used on a commercial level, but is small enough to be transported. Prior art furnaces are generally built onsite and are not easily transported. Fuel-burning furnace 100 can be moved in a number of ways including, but not limited to, being put on a semi trailer or having a hitch and wheel kit to tow it behind a vehicle.

Practical experience with a prototype of the furnace disclosed herein shows a significant cost savings when using the furnace. The furnace has been used to heat several chicken houses on a poultry farm. Due to the relatively low cost of suitable hay and straw in large round bales, the inventors have realized a savings of nearly two thirds of their typical energy bill when heating with the furnace compared to heating the chicken houses with propane. This significant savings in energy costs can make the furnace pay for itself in a very short period of time.

The furnace provides a way for material in the furnace to be ejected from the furnace by the force of new fuel being added to the furnace. The result is a furnace that may be continuously used without having to stop the combustion in the furnace to clean out ash from the furnace.

One skilled in the art will appreciate that many variations are possible within the scope of the claims. Thus, while the disclosure is particularly shown and described above, it will be understood by those skilled in the art that these and other changes in form and details may be made therein without departing from the spirit and scope of the claims. For example, while a two-bale version of the furnace is shown in the drawings and described herein, a single-bale version of the furnace is also within the scope of the disclosure and claims herein.

What is claimed is:

1. A fuel-burning furnace comprising:

a combustion chamber with a front and a back;

at least one door covering the front of the combustion chamber; and a chute having a receiving end coupled to a lower portion of the back of the combustion chamber and a discharge end opposite the receiving end, wherein the loading of fuel into the combustion chamber by pushing the fuel against material in the combustion chamber pushes at least a portion of the material in the combustion chamber into the chute and pushes a portion of the material in the chute out the discharge end of the chute.

2. The fuel-burning furnace of claim 1 wherein the combustion chamber has a curved bottom portion comprising a transverse substantially semi-cylindrical surface.

3. The fuel-burning furnace of claim 1 wherein the chute includes at least one chute door covering the chute.

4. The fuel-burning furnace of claim 3 wherein the at least one chute door is biased to be normally closed when the chute is empty.

5. The fuel-burning furnace of claim 3 wherein the material in the chute presses against the at least one chute door, thereby at least partially opening the at least one chute door and discharging material in the chute out the discharge end of the chute.

6. The fuel-burning furnace of claim 3 further comprising a hand crank coupled to the at least one chute door that allows opening and closing the at least one chute door by turning the hand crank.

7. The fuel-burning furnace of claim 1 further comprising a water chamber surrounding the combustion chamber.

8. The fuel-burning furnace of claim 7 further comprising a hose fitting coupled to the water chamber.

9. The fuel-burning furnace of claim 1 further comprising at least one blower that provides forced air to the combustion chamber.

10. A method for loading a fuel-burning furnace comprising a combustion chamber with a front and a back, at least one door covering the front of the combustion chamber, and a chute having a receiving end coupled to a lower portion of the back of the combustion chamber and a discharge end opposite the receiving end that includes at least one chute door covering the chute, the method comprising the steps of:

opening the at least one door covering the front of the combustion chamber; and pushing fuel through the opening against material in the combustion chamber, thereby forcing at least a portion of the material in the combustion chamber into the chute, wherein the force of the material in the chute on the chute door caused by pushing the fuel against the material in the combustion chamber causes the chute door to at least partially open, thereby discharging at least some of the material in the chute out the discharge end of the chute.

11. A furnace for burning round bales of hay, the furnace comprising:

a combustion chamber having a curved bottom portion comprising a transverse substantially semi-cylindrical surface, the combustion chamber having a front and a back and a longitudinal axis extending from the front to the back;

at least one door covering the front of the combustion chamber;

a chute comprising:

a receiving end coupled to a lower portion of the back of the combustion chamber;

a curved bottom portion that extends a portion of the curved bottom portion of the combustion chamber in a same direction as the longitudinal axis of the combustion chamber;

a discharge end opposite the receiving end; and a chute door coupled via hinge to the discharge end of the chute, wherein the chute door is normally biased closed and opens to discharge material in the chute when the material in the chute is pushed by the loading of fuel into the combustion chamber pushing the material in the chute out the discharge end of the chute.

12. The furnace of claim 11 wherein the material in the chute is pushed against the chute door when a round bale is loaded into the combustion chamber by pushing the round bale against material in the combustion chamber, thereby forcing material in the combustion chamber into the chute and forcing at least a portion of the material in the chute out the discharge end of the chute.

13. The furnace of claim 11 wherein the chute door is normally biased closed by force of gravity.

14. The furnace of claim 11 further comprising a hand crank coupled to the chute door that allows opening and closing the chute door by turning the hand crank.

15. The furnace of claim 11 further comprising a water chamber surrounding the combustion chamber.

16. The furnace of claim 11 further comprising a hose fitting coupled to the water chamber.

17. The fuel-burning furnace of claim 11 further comprising at least one blower that provides forced air to the combustion chamber.

18. A furnace for burning round bales of hay, the furnace comprising:

(A) a combustion chamber having a curved bottom portion comprising a transverse substantially semi-cylindrical surface, the combustion chamber having a front and a back and a longitudinal axis extending from the front to the back;

(B) a water chamber surrounding the combustion chamber so heat is transferred from the combustion chamber to water in the water chamber;

(C) two doors covering the front of the combustion chamber, each of the two doors comprising a blower that provides forced air to the combustion chamber;

(D) a chute comprising:

a receiving end coupled to a lower portion of the back of the combustion chamber;

a curved bottom portion that extends a portion of the curved bottom portion of the combustion chamber in a same direction as the longitudinal axis of the combustion chamber;

a discharge end opposite the receiving end;

a chute door coupled via hinge to the discharge end of the chute, wherein the chute door is normally closed by force of gravity and opens to discharge material in the chute when the material in the chute is pushed against the chute door by the loading of fuel in the combustion chamber pushing the material in the chute against the chute door;

(E) a hand crank coupled to the chute door that allows opening and closing the chute door by turning the hand crank; and (F) a hose fitting coupled to the water chamber.

* * * * *